US009722346B1

(12) United States Patent
McWethy

(10) Patent No.: US 9,722,346 B1
(45) Date of Patent: Aug. 1, 2017

(54) USB-A SLIDE PORT

(71) Applicant: Chris McWethy, Minneapolis, MN (US)

(72) Inventor: Chris McWethy, Minneapolis, MN (US)

(73) Assignee: BBY SOLUTIONS, INC., Richfield, MN (US)

( * ) Notice: Subject to any disclaimer, the term of this patent is extended or adjusted under 35 U.S.C. 154(b) by 0 days.

(21) Appl. No.: 15/078,277

(22) Filed: Mar. 23, 2016

(51) Int. Cl.

| | |
|---|---|
| ***H01R 13/453*** | (2006.01) |
| ***H01R 24/62*** | (2011.01) |
| *H01R 107/00* | (2006.01) |
| *H01R 13/447* | (2006.01) |

(52) U.S. Cl.
CPC ..... *H01R 13/4538* (2013.01); *H01R 24/62* (2013.01); *H01R 13/447* (2013.01); *H01R 13/453* (2013.01); *H01R 13/4532* (2013.01); *H01R 13/4534* (2013.01); *H01R 2107/00* (2013.01)

(58) Field of Classification Search
CPC ..... H01R 13/447; H01R 13/453; H01R 13/4532; H01R 13/4534
USPC ..... 439/136, 137, 138
See application file for complete search history.

(56) References Cited

U.S. PATENT DOCUMENTS

| | | | | |
|---|---|---|---|---|
| 7,086,879 | B2 * | 8/2006 | Higham | H01R 31/06 439/137 |
| 2013/0017696 | A1 * | 1/2013 | Alvarez Rivera | H01R 13/447 439/142 |
| 2013/0189864 | A1 * | 7/2013 | Chen | H01R 13/453 439/136 |

* cited by examiner

*Primary Examiner* — Abdullah Riyami
*Assistant Examiner* — Justin Kratt
(74) *Attorney, Agent, or Firm* — Tysver Beck Evans, PLLC

(57) ABSTRACT

A device which is equipped with a USB connection, and which is configured to receive a USB connector, includes a housing that defines a channel therein. A USB connection is positioned at an end of the channel. A slideable panel is engaged to the channel, and is slideable between a covered position and an uncovered position. In the covered position USB connection covered and protected. In the uncovered position the USB connection is exposed for use. Alternatively, the device does not include the channel and the panel is made up of one or more leaf covers.

4 Claims, 6 Drawing Sheets

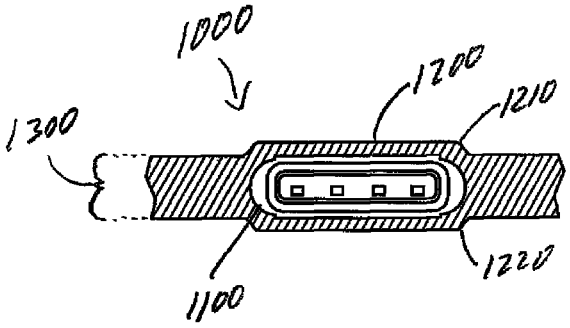
PRIOR ART
FIG. 3
PRIOR ART
FIG. 2
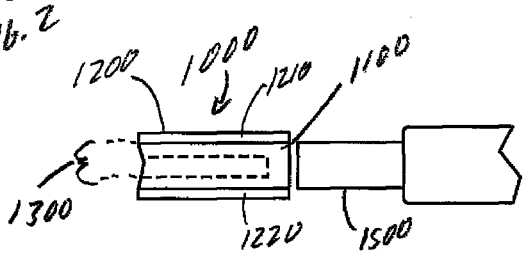
PRIOR ART
FIG. 1
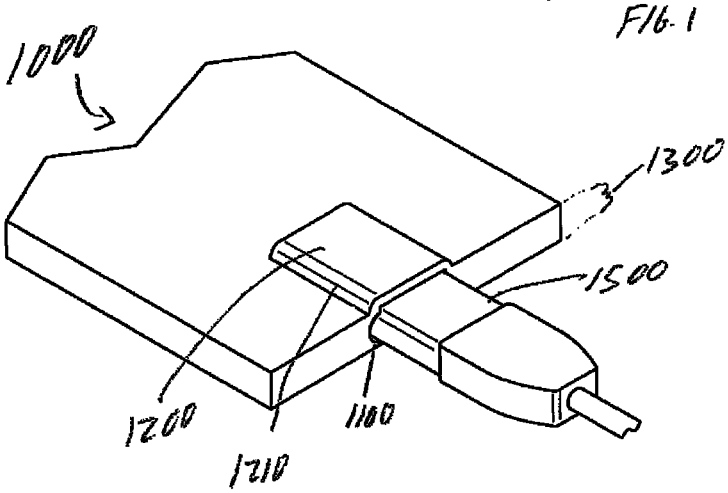

USB-A SLIDE PORT

FIELD OF THE INVENTION

Embodiments of the disclosure are directed to devices equipped with Universal Serial Bus (USB) interfaces and which are of sufficiently small size or profile that the USB port is slimmer than the device to which it is a part. Embodiments provide unique USB port configurations, which protect the port when it is not engaged, but which also allow the port to be connected via conventionally sized USB equipped connectors or devices.

BACKGROUND AND SUMMARY

USB ports have long been the most widely used mechanism or connecting peripheral devices to computers. The prevalence has grown beyond their use in computer hardware and now extends to nearly all realms of electronics where an interface for data or power transfer is required. Some examples of common uses of USB connections are in cell phone chargers and connections for use with small electronic devices.

As small computers and electronic devices continue to profligate, their inevitable miniaturization has lead to certain devices being less than optimally suited to utilize USB connectors for data or power transfer on such devices. Their small size (e.g. credit card sized data storage devices, etc.) prevent the use of a conventional USB port within the internal housing of the device in question; that is the profile of the device in question may be less than the size of the mechanical interface of the USB connector. As a result, many devices are forced to either limit their profile so as to be able to continue to use the USB connector internally, or add ungainly and larger profile protrusions eternal to the otherwise slimmed down device so as to provide for the USB connection port. For example, a PRIOR ART device 1000 is depicted in PRIOR ART FIGS. 1-3. Here, device 1000 may be a cell phone, an electronic data storage device, a camera, etc. Due to its thin profile 1300, device 1000 is provided with a relatively oversized USB receiver port (female) 1100, so as to be able to accommodate the USB connector(male) 1500. As can be seen, due to the slim profile 1300 of the device 1000, the port housing 1200 is required to take the form of fairly significant protrusions extending above the surfaces 1210 and 1220 of the device 1000 (bottom protrusion 1220 is hidden from view in PRIOR ART FIG. 1). The resulting protrusions are not only esthetically disconcerting, but also add unwanted bulk to the device profile 1300 which may make the device 1000 more difficult to handle and store, as well as creating additional surface area that may be readily caught or hung up on pockets, protective sleeves, etc.

Embodiments of the disclosure are directed to overcoming these issues and providing slim or other small devices with USB port configurations that include removable or retractable covers that when in an extended state, cover and protect the USB port, and when in a retracted state allow access and engagement of the port by other conventionally sized USB equipped connectors or devices regardless of their relative size.

BRIEF DESCRIPTION OF THE DRAWINGS

PRIOR ART FIG. 1 is a perspective view of a PRIOR ART device equipped with a USB port (female) engaged to a USB connector (male).

PRIOR ART FIG. 2 is a front view of the PRIOR ART device and USB port illustrating the difference in profile of the port relative to the surrounding device.

PRIOR ART FIG. 3 is a side sectional view of the PRIOR ART device and USB connector (male) shown prior to the connection of the connector to the USB port (female).

DETAILED DESCRIPTION

Figure 4A:
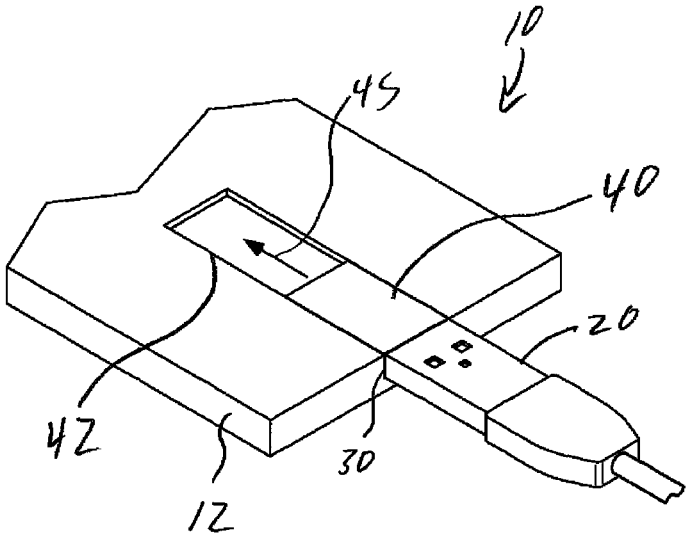
FIGS. 4*a*-4*c* show a perspective view of an embodiment of a device incorporating a USB port (female) wherein the sequence of figures depict the manner in which a USB connector (male) engages the port.

Turning now to the FIGS. 4-10, which illustrate representative embodiments of the invention disclosed herein, an electronic device 10 is shown having a thin, compact or otherwise slim profile. As used herein the term profile refers to the thickness of the electronic device in relation to the thickness of the interface required for a typical USB connection. A device 10 having a slim profile has a thickness that is equal to or less than that of a "male" USB connector 20. A device 10 having such a slim profile relative to a male USB connector 20 is depicted in the various FIGS. 4-10.

In order to provide a device 10 having a slim profile with a USB connection interface or "female" USB connection 30 without enlarging the profile of the device at least in the region of the connection (see discussion of PRIOR ART above), the connection 30 must either be exposed, which would not be ideal as it would expose the connection 30 to negative environmental conditions (dust, moisture, etc.), or include a removable cover so as to require a user to remove a portion of the device housing 12 from an area adjacent (covering) to the connection 30 so as to allow the male connector 20 access to the connection port 30 without interference.

Removing portions of the device housing 12 to make the connection 30 available for use is less than ideal for a variety of reasons (inconvenient, potential loss of component, etc.). The present disclosure includes a variety of alternatives to this situation and which allows free access of the connection 30 via a standard connector 20 regardless of how slim the profile of the device 10 may be.

Figure 5A:
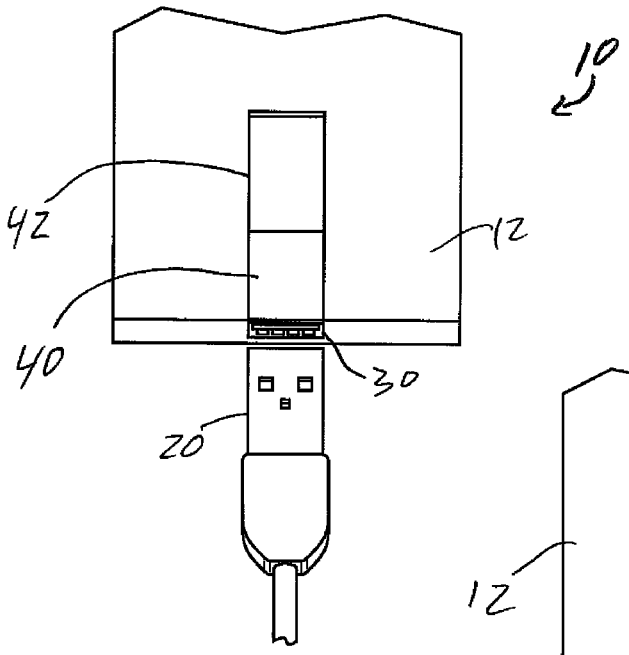
FIGS. 5*a*-5*c* show a front perspective view of the embodiment and sequence shown in FIGS. 4*a*-4*c*.
Figure 5B:
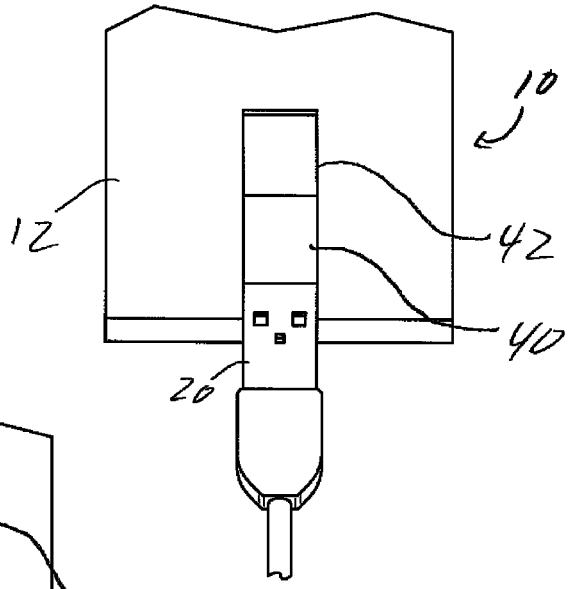

In one embodiment, such as is shown in FIGS. 4*a* and 5*a*, the device 10 is provided with a sliding panel 40, which overlays the connection 30 when the connection is in the unused or unconnected state (i.e. prior to being interfaced with connector 20). The panel 40 lies within a channel 42 defined by the device housing 12 and which the connection 30 is located at one end. The panel 40 may be of any construction, shape or size, but in the embodiment shown (taking into account its position within the channel 42) the panel 40 is effectively of the same thickness and composition as the surrounding housing 12, thereby providing the device with a fairly uniform profile 14 in both the unconnected state or connected state.

In at least one embodiment, the panel 40 has a length (represented illustratively in FIG. 4*b* as Lp) at least as long as that of the male USB connector 20; whereas the channel 42 has a length (represented illustratively in FIG. 4*b* as Lc) at least twice that of the panel 40. This arrangement provides sufficient room for the panel 40 to slide along the length of the channel 42 (in the direction of arrow 45 shown in FIGS. 4*a* and 4*b*) from the unconnected or covered state shown in FIG. 4*a* to the connected or uncovered state shown in FIG. 4*c* and ensure that the panel 20 does not interfere with the ability of the of the connector 20 to fully engage the connection 30.

In the embodiment shown in FIGS. 4 and 5 the panel 40 is retained by the channel 42 by simple mechanical engagement (friction fit). In some embodiments an additional feature or features such as one or more tabs, stops, teeth, etc. are include in either or both of the panel 40 and channel 42 to aid in ensuring that the panel 40 is retained within the channel 42 regardless of the absence or presence of the connector 20.

Figure 4B:
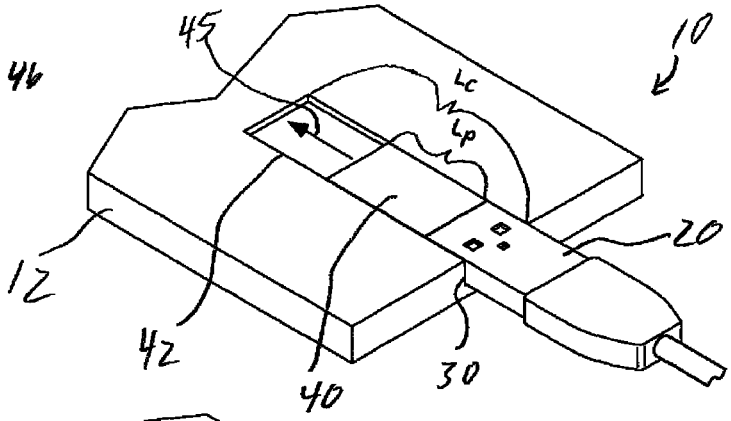
Figure 4C:
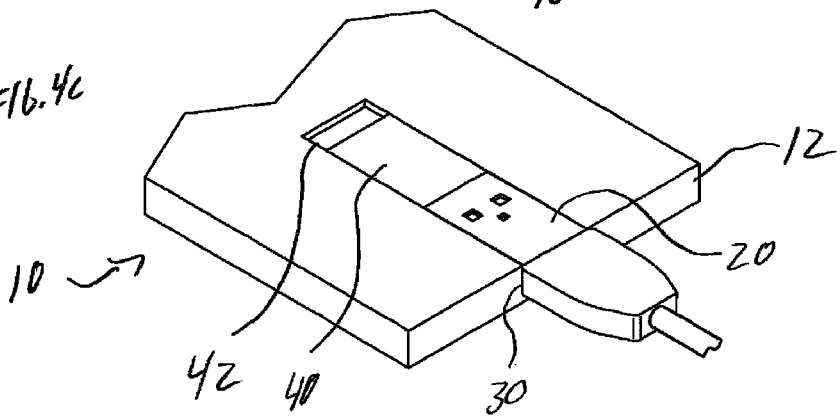
Figure 5C:
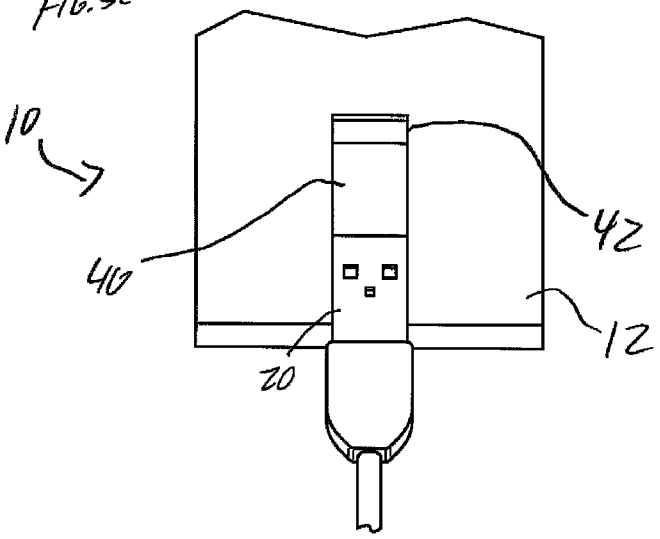

In the embodiment shown in FIGS. 4*a*-4*c* and 5*a*-5*c*, the act of pushing or plugging the connector 20 into engagement with the connection 30 also causes the connector 20 to contact the panel 40 and push it along the length of the channel 42 in the manner shown in FIGS. 4*b* and 5*c*. Upon removal of the connector 20 from the connection 30 the panel 40 may be biased back into the unconnected position shown in FIGS. 4*a* and 5*b* by a variety of mechanisms.

Figure 6:
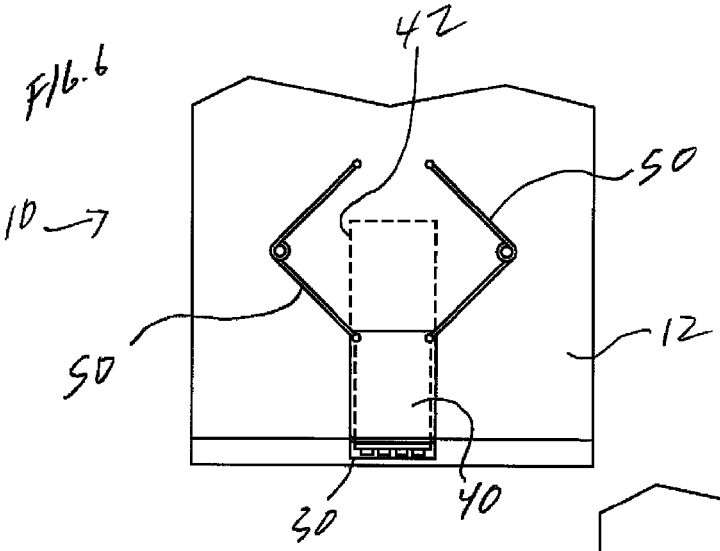
FIG. 6 is a top down, cut-away, perspective view of an embodiment showing an alternative biasing mechanism.
Figure 7:
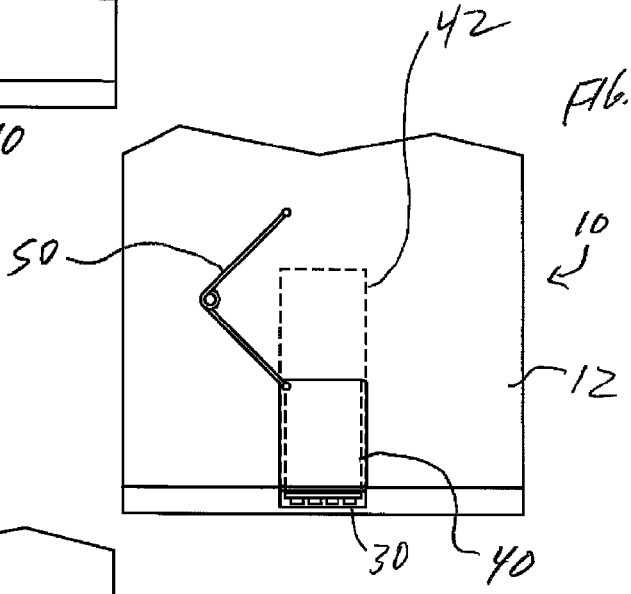
FIG. 7 is a top down, cut-away, perspective view of an embodiment showing an alternative biasing mechanism.

In some embodiments, the device 10 includes one or more biasing members, such as one or more torsion springs 50 shown in FIGS. 6 and 7, which are contained within the housing 12, and are moveably engaged at one end to the panel 40 so as to bias the panel 40 toward the unconnected position shown. Pressing a connector 20 into engagement with the connection 30, such in the manner shown in FIGS. 4*a*-4*c*, provides sufficient force to overcome the force of the biasing members and thereby displace the panel 40 along the channel 42 in the manner previously described. When the connector 20 is removed from the connection 30, the biasing member(s) act to move the panel back in to the unconnected state thereby covering the connection 30.

Figure 8:
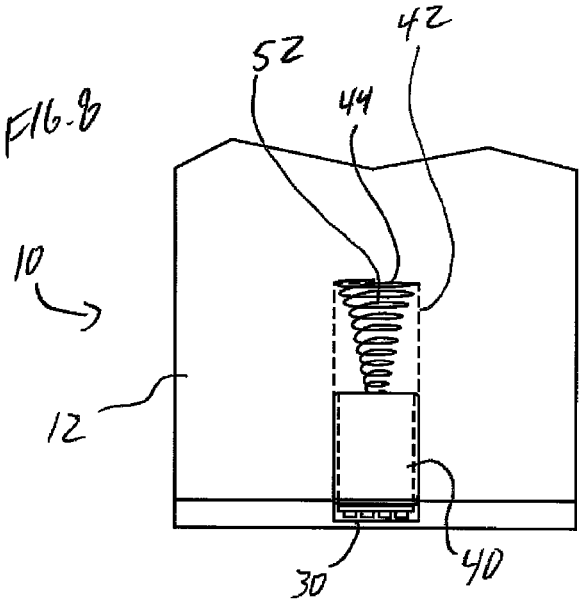
FIG. 8 is a top down, cut-away, perspective view of an embodiment showing an alternative biasing mechanism.

As mentioned above, in some embodiments the biasing member is in the form of one or more torsion springs 50, such as those depicted in FIGS. 6 and 7. In at least one embodiment, such as is shown in FIG. 8, a biasing member is instead a coil spring 52 positioned within or adjacent to the channel 42 and biased between the back 44 of the channel 42 and the panel 40. One of ordinary skill in the art will recognize that many varieties of springs, clips or other biasing members may be utilized to bias the panel 40 towards the unconnected or covered position shown in FIGS. 6-8.

Figure 9A:
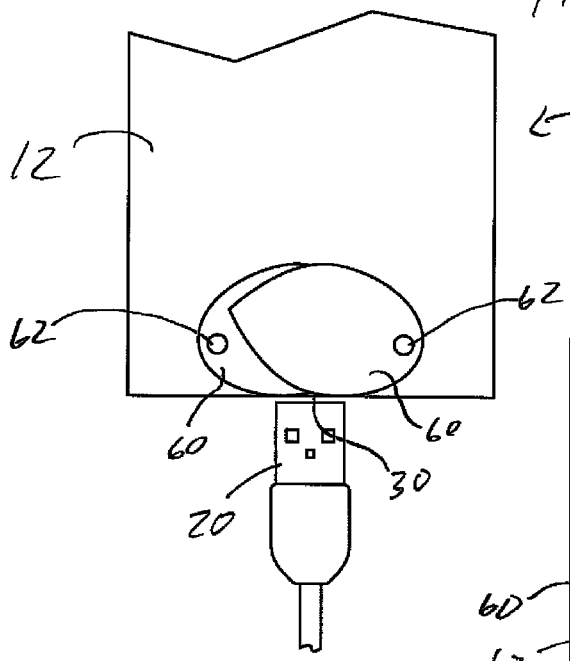
FIGS. 9*a*-9*c* show a top down view of an alternative embodiment of a device incorporating a USB port (female) wherein the sequence of figures depict the manner in which a USB connector (male) engages the port.
Figure 9B:
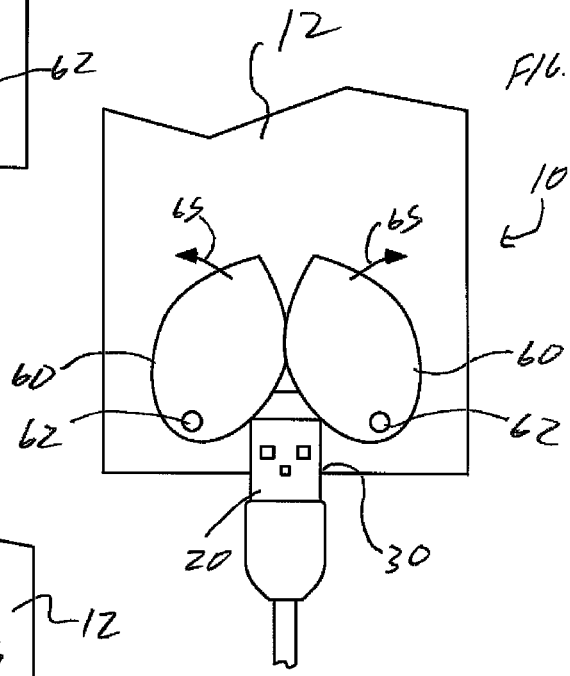
Figure 9C:
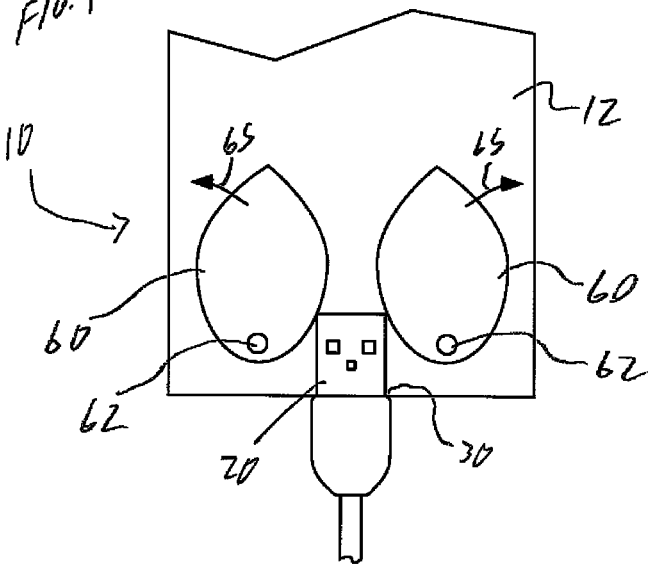
Figure 10A:
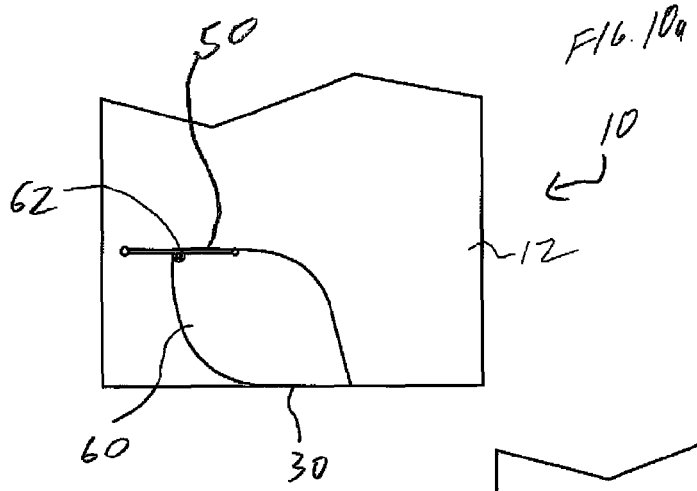
FIGS. 10*a*-10*c* show a detailed, cut-away, perspective of a portion of the embodiment shown in FIGS. 9*a*-9*c* where in a biasing mechanism of the port cover is shown.
Figure 10B:
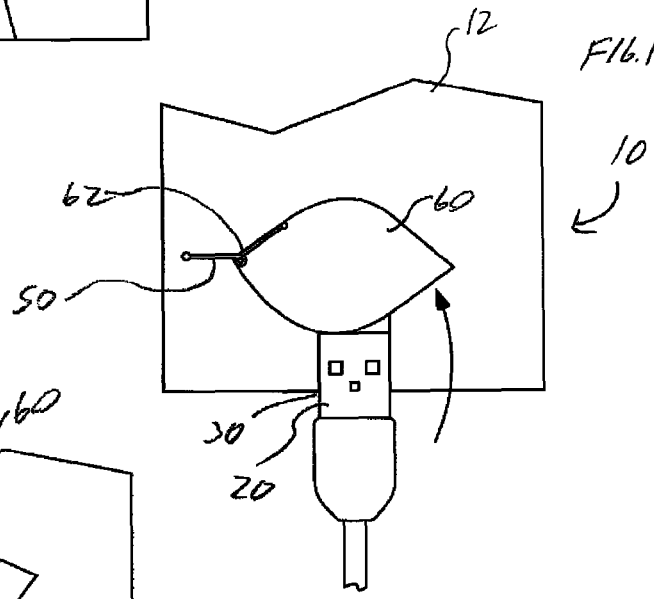
Figure 10C:
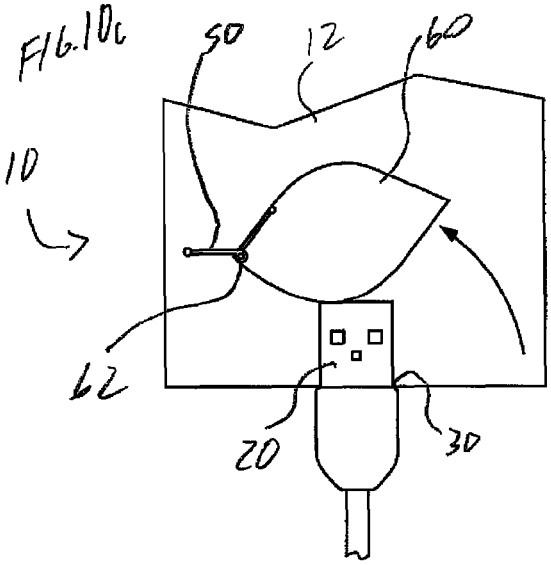

Turning now to the embodiments shown in FIGS. 9 and 10, here an alternative to the sliding panel configuration discussed thus far is shown. Rather than include a panel within a channel defined by of the housing, in the embodiment shown in FIGS. 9 and 10 the housing 12 includes one or more panels in the form of leaf covers 60 that are pivotally engaged to the housing 12 at pivot joint 62. Each leaf cover 60 is shaped and sized to overlap the connection 30 when in the unconnected or covered state shown in FIGS. 9*a* and 10*a*. Where multiple leaf covers are employed, such as in the embodiment shown in FIGS. 9*a*-9*c*, the covers 60 are arranged in an overlapping—one on top of the other style—pattern.

Regardless of whether one cover 60 or two overlapping covers 60 are used, inserting a connector 20 into the connection 30 displaces each leaf cover 60 away from the connection 30 (in the direction indicated by arrows 65 shown in FIGS. 9*b*-9*c* and 10*b*-10*c*) so as to allow the connector 20 to fully interface with the connection 30 without interference when in the connected state shown in FIG. 9C.

The direction and degree of displacement of the leaf cover 60 is a function of the position of the pivot joint 62 and the amount of space provided by the housing 12 within which the cover is free to move. In some embodiments, leaf covers 60 may be internal or external to the housing 12. When external, the covers 60 essentially rest on or slightly above the housing surface. While such an external mounting configuration does add to the profile of the device 10, the relatively thin nature of the cover(s) 60 is minimal compared to the relatively bulky protrusions illustrated in the PRIOR ART FIGS. 1-3.

As with other embodiments of the invention various biasing mechanisms can be used to bias the leaf cover(s) 60 into the unconnected or covered state such as is shown in FIGS. 9*a* and 10*a*. In at least one embodiment, shown in FIGS. 10*a*-10*c*, a leaf cover 60 is equipped with a torsion spring 50 acting as the pivot joint 62. Reiterating the description above, in this configuration the spring 50 biases the cover 60 over the connection 30 when in the unconnected or covered state shown in FIG. 10*a*. As a connector 20 is inserted into the connection 30, the connector 20 pushes against the cover 60 to overcome the biasing force supplied by the spring 50 and displace the cover 60 from the area over the connection 30 in the direction of the arrow shown in FIGS. 10*b* and 10*c*. Upon removal of the connector 20 the cover 60 returns to the covered state shown in FIG. 10*a*.

It will be recognized that cover 60 may be of any shape, size or configuration suitable for covering connection 30 and may include any of a variety of pivot joint and/or biasing member configurations, which one of ordinary skill in the art will recognize as being suitable for use in allowing the cover(s) to be displaced and repeatedly returned to a covered position in the manner described.

It should also be noted that while in the various embodiments shown in FIGS. 4-10, a generic "USB" port (female) connection 30 and (male) connector 20 have been depicted. The connections and connectors described herein may be any type of USB connector and connection, including but not limited to USB type A, type B, type C, Mini USB, Micro USB, USB 1.0-3.1, etc.

The many features and advantages of the invention are apparent from the above description. Numerous modifications and variations will readily occur to those skilled in the art. Since such modifications are possible, the invention is not to be limited to the exact construction and operation illustrated and described. Rather, the present invention should be limited only by the following claims.

What is claimed is:

1. A device having a USB connection for receipt of a USB connector, the device comprising:

a housing, a USB connection at least partially contained within the housing, two slideable covers arranged in an overlapping configuration and slidingly engaged to the housing and having a covered position and an uncovered position, in the covered position the two slideable covers covering at least a portion of the USB connection, in the uncovered position the USB connection being exposed for use.

2. The device of claim 1, wherein the two slideable covers are each engaged to the housing at a pivot joint.

3. The device of claim 2, wherein the pivot joint comprises a biasing member, the biasing member being biased between the housing and at least one of the two slideable covers, the at least one biasing member biasing the at least one slideable cover to remain in the covered position until acted on by contact with a USB connector.

4. The device of claim 3, wherein the biasing member is a torsion spring.

* * * * *